US009551304B2

(12) United States Patent
Haefele

(10) Patent No.: US 9,551,304 B2
(45) Date of Patent: Jan. 24, 2017

(54) TANK VENTING SYSTEM AND METHOD FOR DIAGNOSING SAME

(71) Applicant: Robert Bosch GmbH, Stuttgart (DE)

(72) Inventor: Matthias Haefele, Gingen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 297 days.

(21) Appl. No.: 14/351,474

(22) PCT Filed: Sep. 19, 2012

(86) PCT No.: PCT/EP2012/068422
§ 371 (c)(1),
(2) Date: Apr. 11, 2014

(87) PCT Pub. No.: WO2013/053574
PCT Pub. Date: Apr. 18, 2013

(65) Prior Publication Data

US 2014/0345574 A1 Nov. 27, 2014

(30) Foreign Application Priority Data

Oct. 13, 2011 (DE) ..... 10 2011 084 403

(51) Int. Cl.
*F02M 25/08* (2006.01)

(52) U.S. Cl.
CPC ..... *F02M 25/0836* (2013.01); *F02M 25/0809* (2013.01); *F02M 25/0818* (2013.01)

(58) Field of Classification Search
CPC ..... F02M 25/0836; F02M 25/0809; F02M 25/0818; F02M 2025/0863; F02M 25/08; F02M 25/0854; F02M 33/02; F02M 25/0872; F02M 25/089; F02D 19/0621; F02D 41/003; F02D 41/0032; F02D 41/0037; F02D 41/004; F02D 41/0042; F02D 41/0045
(Continued)

(56) References Cited

U.S. PATENT DOCUMENTS 5,592,923 A 1/1997 Machida
6,363,921 B1 * 4/2002 Cook ..... F02M 25/0809 123/519
(Continued)

FOREIGN PATENT DOCUMENTS

DE 100 43 071 3/2002
DE 10 2006 016339 10/2007
DE 10 2009 008831 8/2010

OTHER PUBLICATIONS

International Search Report for PCT/EP2012/068422, dated Apr. 9, 2013.

*Primary Examiner* — Hung Q Nguyen
*Assistant Examiner* — Xiao Mo
(74) *Attorney, Agent, or Firm* — Norton Rose Fulbright US LLP; Gerard Messina

(57) ABSTRACT

A tank venting system of an internal combustion engine having an intake manifold, a fuel tank, and an activated carbon filter includes: a tank vent valve; at least one check valve; and a pressure sensor situated between the tank vent valve and the check valve. For diagnosing this tank venting system, a negative pressure which is lower than the ambient pressure outside the engine system is stored between the tank vent valve and the check valve. The stored pressure is changed by controlling the tank vent valve, and the change in the pressure is measured via the pressure sensor. The functioning of the tank venting line, of the check valve, and of the tank vent valve is deduced from the correlation of the
(Continued)

opening state of the tank vent valve with the change in pressure.

6 Claims, 5 Drawing Sheets

(58) Field of Classification Search
USPC ..... 123/518–521
See application file for complete search history.

(56) References Cited

U.S. PATENT DOCUMENTS

| | | | | |
|---|---|---|---|---|
| 2005/0044938 | A1 | 3/2005 | Tsuruta | |
| 2010/0223984 | A1* | 9/2010 | Pursifull | F02M 25/0836 73/114.39 |
| 2010/0224171 | A1* | 9/2010 | Peters | F02M 25/089 123/520 |
| 2012/0152210 | A1* | 6/2012 | Reddy | F02M 25/089 123/520 |

* cited by examiner

TANK VENTING SYSTEM AND METHOD FOR DIAGNOSING SAME

BACKGROUND OF THE INVENTION

1. Field of the Invention

The present invention relates to a tank venting system and to a method for diagnosing the tank venting system.

2. Description of the Related Art

Present internal combustion engines have tank venting systems in which fuel that has evaporated in the tank is stored in an activated carbon filter which is connected to the intake manifold of the internal combustion engine via a closable tank vent valve. When the tank vent valve is open, air is drawn in via a connection of the activated carbon filter to the environment, entraining the temporarily stored fuel and supplying it for combustion. The quantity of gas that is drawn in is controlled via the tank vent valve in such a way that on the one hand the activated carbon filter is sufficiently purged with air, and on the other hand, unacceptably large disturbances of the fuel/air ratio of the mixture supplied to the internal combustion engine do not occur.

In order to comply with regulatory requirements, a defective tank vent valve that is installed in a tank venting system must now be recognized as defective via suitable diagnoses. It is already known to open a tank vent valve during operation of the engine and to evaluate a response from a fuel/air ratio control loop for the diagnoses. The fuel vapor from the tank venting (regeneration gas) mixed with air causes a disturbance of the control loop, so that the occurrence of the disturbance indicates properly functioning tank ventilation, and thus in particular a properly functioning tank vent valve. This is described in published German patent application document DE 100 43 071 A1, for example.

It may be provided to repeatedly open the tank vent valve and to use a statistical analysis of a change in the mixture, which results from activating the valve and which is detected with the aid of a lambda sensor, for the diagnosis. This check may be made during idling and also during partial load operation of the internal combustion engine. In the process, the tank vent valve is slowly activated in a ramp-like manner without the overall system taking this activation into account. In other words, during the activation of the tank vent valve, the air and fuel components which are supplied to the engine via the tank vent valve are not taken into account. An intact or defective tank vent valve may be deduced via the response of the overall system to this occurring disturbance variable, which represents a mixture deviation. However, in the event that the mass flow which is conducted via the tank vent valve now contains no hydrocarbon molecules, i.e., when an unloaded activated carbon filter is "purged," this does not result in a response from the lambda control after the tank vent valve is opened, and therefore it cannot be determined whether a defective tank vent valve is present. In other words, although the tank vent valve is properly activated, it is possible that no mixture deviation is determined, so that, as mentioned, a conclusion cannot be drawn concerning the functioning of the tank vent valve.

Charge detection is carried out with the aid of a hot film air mass sensor, for example. Charge detection with the aid of an intake manifold pressure sensor is also known. In this type of charge detection, the gas which is additionally introduced into the system and thus into the intake manifold via the tank vent valve is measured with the aid of an intake manifold pressure sensor.

In recent hybrid vehicles, the internal combustion engine is continually started and stopped. This makes it necessary to carry out the required diagnostic method for the tank venting system as quickly as possible so as not to hinder other diagnoses.

BRIEF SUMMARY OF THE INVENTION

In the tank venting system according to the present invention, which includes an internal combustion engine having an intake manifold, a fuel tank, an activated carbon filter, a tank vent valve, and at least one check valve, a pressure sensor is situated between the tank vent valve and the check valve. The tank venting system according to the present invention may be used for naturally aspirated engines, for example. In this case, the tank venting system has a check valve. The tank venting system according to the present invention may also be used for supercharged engines. When the supercharged engines have an additional full load inlet point for the tank ventilation, the tank venting system according to the present invention usually has two check valves, namely, a check valve in each line which leads from the tank vent valve to the air supply system of the supercharged engine.

To design the tank venting system in a manner that is easy to install, according to the present invention it is preferred that the tank vent valve and at least one check valve have a one-piece design. In this case, a cavity in which the first pressure sensor is situated is present between the check valve and the tank vent valve. This preferred specific embodiment of the present invention is suitable for systems having a check valve in the tank venting line(s).

The functioning of the tank venting system, of the tank venting line, and of the check valves may be easily diagnosed in the tank venting system according to the present invention. For this purpose, according to the present invention a method is provided in which a negative pressure $p_1$ which is less than ambient pressure $p_u$ outside the tank venting system is stored between the tank vent valve(s) and the check valve. The lowest value that pressure $p_1$ may assume corresponds to the lowest value that pressure $p_2$ in the intake manifold of the internal combustion engine may assume. When the tank vent valve is closed, the negative pressure results in closing of the check valves, and remains constant when the tank venting lines and valves are intact. The stored pressure may be changed in a targeted manner by controlling the tank vent valve. The change in the pressure between the tank vent valve and the check valve is measured via the first pressure sensor and associated with the control of the tank vent valve. The functioning of the tank venting lines, of the check valves, and of the tank vent valve is deduced from the correlation of the opening state of the tank vent valve with the change in pressure $p_1$ between the tank vent valve and the check valve. According to the present invention, a correlation is understood to mean a causal relationship between the opening state of the valve and the change in pressure.

The diagnostic method according to the present invention may be used when the internal combustion engine is switched off, when the internal combustion engine is started, and when the internal combustion engine is running. When the internal combustion engine is switched off, according to the present invention it is preferred that the tank vent valve is opened and subsequently reclosed when pressure $p_1$, measured by the pressure sensor, between the tank vent valve and the check valve is not equal to ambient pressure $p_u$. For this purpose, the ambient pressure is measured outside the tank venting system via a further sensor. After the tank vent valve is closed, an upward sensor drift is recognized if pressure $p_1$ is greater than the sum of ambient pressure $p_u$ and an error threshold. If pressure $p_1$ is less than the sum of ambient pressure $p_u$ and an error threshold after the tank vent valve is closed, a check is initially made as to whether the internal combustion engine has been switched off for a long or for a short time prior to the diagnosis. According to the present invention, a long switched-off period is considered to be a time period in which a negative pressure $p_1$ which has been stored prior to switching off the internal combustion engine usually returns to ambient pressure $p_u$. This value is a function of the seal-tightness of the check valves and the stored pressure difference between $p_1$ and $p_u$ when the internal combustion engine is switched off. According to the present invention, a time period that exceeds a fixed time period t is usually considered to be a long switched-off period, and a time period having a maximum value of fixed time period t is considered to be a short switched-off period. Fixed time period t is the time during which pressure $p_1$ is less than the ambient pressure, when the check valves and the tank vent valve are intact. This time period t may be ascertained by measurement, and may subsequently be stored in a computer program, for example. For a long switched-off period after the tank vent valve has been closed, if it is recognized that measured pressure $p_1$ is less than a setpoint pressure $p_{1s}$ which is ascertained over the switched-off period on the basis of the difference of pressure $p_1$ the last time the internal combustion engine was switched off with respect to ambient pressure $p_u$, the curve of $p_1$ is measured when the internal combustion engine is started, and a downward sensor drift is recognized if at any point in time during the starting operation, $p_1$ is less than pressure $p_2$ in the intake manifold of the internal combustion engine by an error threshold, and at the end of the starting operation is less than minimum achieved pressure $p_2$. For this purpose, pressure $p_2$ is measured via a further pressure sensor in the intake manifold of the internal combustion engine, or is ascertained with the aid of the intake manifold pressure model which is computed using the air mass flow of a hot film air mass sensor. For a short switched-off period, if pressure $p_1$ is less than a setpoint pressure $p_{1s}$ which is ascertained over the switched-off period after the tank vent valve is closed on the basis of the difference of pressure $p_1$ at the last time the internal combustion engine was switched off and ambient pressure $p_u$, the curve of $p_1$ is likewise measured when the internal combustion engine is started, and a downward sensor drift is recognized if at any point in time during the starting operation, $p_1$ is less than pressure $p_2$ in the intake manifold by an error threshold, and at the end of the starting operation is less than minimum pressure $p_2$. In addition, at the end of the starting operation of the internal combustion engine, the tank vent valve may be opened and reclosed when pressure $p_2$ is less than ambient pressure $p_u$, and a blockage of the tank vent valve is deduced when pressure $p_1$ does not increase to pressure $p_2$. These method steps according to the present invention allow a diagnosis of the tank vent valve, of the check valves, and of the inlet point into the intake manifold directly during starting of the internal combustion engine, which allows the time period of operation of the internal combustion engine to be utilized for other diagnoses, and does not require intentional starting of the internal combustion engine just for diagnoses of the tank venting system.

According to the present invention, it is further preferred that when the internal combustion engine is started, a check is made as to whether measured pressure $p_1$ is not equal to pressure $p_2$ in the intake manifold of the internal combustion engine. In this case, it is recognized that the line between the pressure sensor and the inlet point of the tank venting line into the air supply system of the internal combustion engine is interrupted when pressure $p_1$ is equal to ambient pressure $p_u$. If pressure $p_1$ is less than ambient pressure $p_u$ and is greater than pressure $p_2$ in the intake manifold, and pressure $p_1$ is equal to pressure $p_2$ plus an offset during continued operation of the internal combustion engine, the result of the diagnosis is a function of the magnitude of the offset. For this purpose, a lower limiting pressure $p_{1u}$ is defined as pressure $p_1$ which is measured at the pressure sensor when the tank vent valve is open and the line between the tank vent valve and the check valve(s) is intact. An upper limiting pressure $p_{1o}$ is defined as the pressure which is measured at the pressure sensor when the valves are intact but the line between the tank vent valve and the check valve(s) has fallen off. These pressures are different, since the mass flow which flows via the tank venting lines into the intake manifold of the internal combustion engine when an open tank vent valve and intact tank venting lines are present is less than the mass flow into the intake manifold only via the tank venting lines when the line has fallen off. When the tank vent valve is open, this results in a greater throttle effect and thus a lower pressure $p_1$ than when the line between the tank vent valve and the pressure sensor has fallen off. Lower limiting pressure $p_{1u}$ may be computed from pressure $p_2$ in the intake manifold and the throttle factor of the open tank vent valve. Upper limiting pressure $p_{1o}$ may be computed from pressure $p_2$ in the intake manifold and the throttle factor when the line between the tank vent valve and the pressure sensor has fallen off. For a pressure $p_1$ that is greater than lower limiting pressure $p_{1u}$ and less than or equal to upper limiting pressure $p_{1o}$ (large offset), it is recognized that the pressure line between the pressure sensor and the tank vent valve is defective. For a pressure $p_1$ that is less than or equal to lower limiting pressure $p_{1u}$ (small offset) and greater than intake manifold pressure $p_2$, in an engine system having an inlet point (inlet point into the intake manifold) it is recognized that the tank vent valve is open. In an engine system having two inlet points (inlet point into the intake manifold and full load inlet point of a supercharged engine), it is recognized that the check valve of the full load inlet point is defective if a pressure jump occurs when the tank vent valve is energized, and that the pressure line between the pressure sensor and the tank vent valve is defective if no pressure jump occurs when the tank vent valve is energized. These method steps allow a diagnosis of the tank venting system even during starting of the internal combustion engine and operation of the internal combustion engine without purge volume losses.

If during operation of the internal combustion engine no pressure jumps in pressure $p_1$ occur when the tank vent valve is opened and subsequently closed, this indicates a defect in the tank venting system. During engine operation with natural aspiration, i.e., when pressure $p_2$ in the intake manifold of the internal combustion engine is less than ambient pressure $p_u$, in this case five different defects may be recognized. If the tank vent valve has already been recognized as defective, it is additionally recognized that the tank vent valve is jammed open if pressure $p_1$ is less than or equal to lower limiting pressure $p_{1u}$ and greater than intake manifold pressure $p_2$. If a diagnosis of the tank vent valve is not possible, a line defect between the tank vent valve and the pressure sensor is recognized if pressure $p_1$ is greater than lower limiting pressure $p_{1u}$ and less than or equal to upper limiting pressure $p_{1o}$. If a diagnosis of the tank vent valve is not possible, a line defect between the intake manifold and the pressure sensor is recognized if pressure $p_1$ is equal to ambient pressure $p_u$. If pressure $p_1$ is less than or equal to pressure $p_2$ in the intake manifold and remains at minimum stored intake manifold pressure $p_2$, it is recognized that the tank vent valve is jammed shut. If pressure $p_1$ is equal to pressure $p_2$, it is recognized that the tank vent valve is jammed shut and the check valve is defective. For a positive pressure in the intake manifold, i.e., when pressure $p_2$ in the intake manifold is greater than ambient pressure $p_u$, three different defects may be recognized. If pressure $p_1$ drops with increasing pressure $p_2$, it may be recognized, as a function of the change in pressure $p_1$ with respect to ambient pressure $p_u$, whether the tank vent valve is jammed open or jammed shut. If pressure $p_1$ is equal to ambient pressure $p_u$ when the tank vent valve is closed, it is recognized that the full load venting line is defective (this occurs only in supercharged engines having full load tank venting). If pressure $p_1$ is greater than ambient pressure $p_u$, and pressure $p_1$ is correlated with pressure $p_2$, it is recognized that the check valve is defective.

The method according to the present invention also allows a check of the line between the tank vent valve and the inlet point into the intake manifold when the internal combustion engine is running. If the tank vent valve is closed during operation of the internal combustion engine, pressure $p_1$ is less than or equal to pressure $p_2$ in the intake manifold, and pressure $p_2$ is less than the ambient pressure, three different defects may be recognized. Falling off of the line is recognized if pressure $p_1$ is equal to ambient pressure $p_u$. A downward sensor drift of the pressure sensor is recognized if measured pressure $p_1$ is continuously less than pressure $p_2$ by an offset. The check valve is recognized as jammed open if pressure $p_1$ is equal to pressure $p_2$ with increasing pressure $p_2$. When the tank vent valve is open, it is recognized that the line between the tank vent valve and pressure sensor $p_1$ has fallen off if pressure $p_1$ is greater than lower limiting pressure $p_{1u}$ and less than or equal to upper limiting pressure $p_{1o}$. If pressure $p_1$ is less than or equal to lower limiting pressure $p_{1u}$ and greater than intake manifold pressure $p_2$, it is recognized that the tank vent valve is open and that the line between the intake manifold and the tank vent valve is intact. If pressure $p_1$ is equal to ambient pressure $p_u$, it is recognized that the line between the tank vent valve and the pressure sensor has fallen off.

In addition, by use of the method according to the present invention, a check of the line between the tank vent valve and the full load inlet point is possible during operation of an internal combustion engine having two tank venting inlet points. For this purpose, during operation of the internal combustion engine with the tank vent valve closed, if intake manifold pressure $p_2$ increases from a value that is less than ambient pressure $p_u$ to a value that is greater than ambient pressure $p_u$, and if pressure $p_1$ is less than ambient pressure $p_u$, pressure $p_1$ is increased to ambient pressure $p_u$ by opening and closing the tank vent valve. If pressure $p_2$ in the intake manifold is greater than ambient pressure $p_u$, and pressure $p_1$ corresponds to ambient pressure $p_u$, it is recognized that the line between the full load inlet point and the pressure sensor is defective. If pressure $p_2$ in the intake manifold is greater than ambient pressure $p_u$, and pressure $p_1$ corresponds to a pressure $p_v$ at the Venturi nozzle, it is recognized that the tank vent valve is jammed shut. Pressure $p_v$ at the Venturi nozzle may be ascertained with the aid of the Bernoulli equation. If pressure $p_2$ in the intake manifold is greater than ambient pressure $p_u$, and pressure $p_1$ is greater than lower limiting pressure $p_{1u}$ and less than or equal to upper limiting pressure $p_{1o}$, it is recognized that the line between the tank vent valve and the pressure sensor is defective. If pressure $p_2$ in the intake manifold is greater than ambient pressure $p_u$, and pressure $p_1$ is greater than ambient pressure $p_u$, it is recognized that a check valve is defective. If the tank vent valve is open or closed at a pressure $p_2$ in the intake manifold which is greater than ambient pressure $p_u$ and no pressure jump to $p_1$ is measurable, it is recognized that the tank vent valve is defective. When the tank vent valve is jammed open, pressure $p_1$ corresponds to lower limiting pressure $p_u$, and when the tank vent valve is jammed shut, pressure $p_1$ corresponds to pressure $p_v$ at the Venturi nozzle.

In addition, the method according to the present invention allows a check of the check valves during operation of the internal combustion engine. Prior to switching off the internal combustion engine, the tank vent valve is closed in order to store pressure $p_2$ in the intake manifold between the tank vent valve and the check valve as pressure $p_1$ between the tank vent valve and the check valve(s). After closing the tank vent valve, if an increase in pressure $p_1$ is measured and the tank vent valve and the line have been assessed as defect-free, three defect diagnoses are possible. It is recognized that the check valve of the inlet point in the intake manifold is defective if pressure $p_1$ is always equal to pressure $p_2$, provided that pressure $p_2$ is less than ambient pressure $p_u$. If pressure $p_1$ is always greater than pressure $p_2$ and less than ambient pressure $p_u$, it is recognized that the check valve of the line between the tank vent valve and the full load inlet point is defective. In addition, with the aid of pressure $p_1$ which is stored during the shutoff operation, it may once again be checked whether the tank vent valve is functioning by opening the tank vent valve at an intake manifold pressure $p_2$ that is equal to ambient pressure $p_u$, with the internal combustion engine switched off. Stored pressure $p_1$, which is less than ambient pressure $p_u$, jumps to ambient pressure $p_u$ when the tank vent valve is functioning. If no change in pressure is apparent, it is recognized that the tank vent valve is jammed shut.

Moreover, the present invention relates to a computer program which executes all steps of the method according to the present invention when it runs on a computer. This allows the simple implementation of the method according to the present invention in the diagnostic electronics system of a motor vehicle which is present anyway. Lastly, the present invention relates to a computer program product having program code, stored on a machine-readable medium, for carrying out the method according to the present invention when the program is executed on a computer or a control unit.

DETAILED DESCRIPTION OF THE INVENTION

Figure 1:
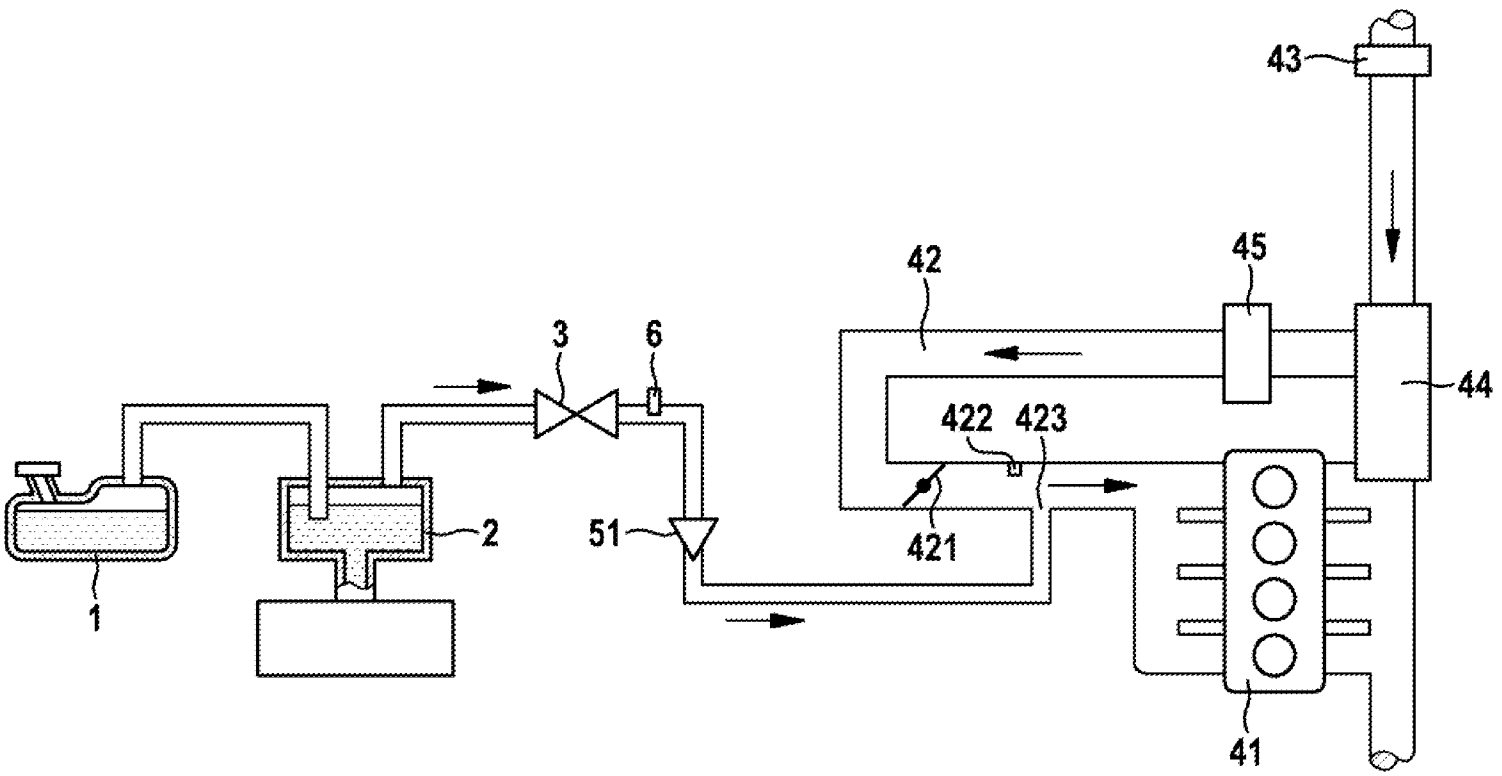
FIG. 1 shows a tank venting system according to the present invention, having a tank venting inlet point for engine operation with natural aspiration.

FIG. 1 shows a tank venting system according to a first specific embodiment of the present invention. A fuel tank 1 is connected to an activated carbon filter 2. A line leads from activated carbon filter 2 to a tank vent valve 3. A line leads from this tank vent valve 3 to intake manifold 42 of an internal combustion engine 41. A check valve 51 which allows transport of fluids only in the direction of intake manifold 42 is situated in this line. A pressure sensor 6 is situated between tank vent valve 3 and check valve 51. Ambient air is transported into a turbocharger 44 via an air filter 43. From there, the air is relayed into intake manifold 42 via a charge air cooler 45. A throttle valve 421 and an intake manifold pressure sensor 422 are situated in the intake manifold. The intake manifold is connected to internal combustion engine 41.

Figure 2:
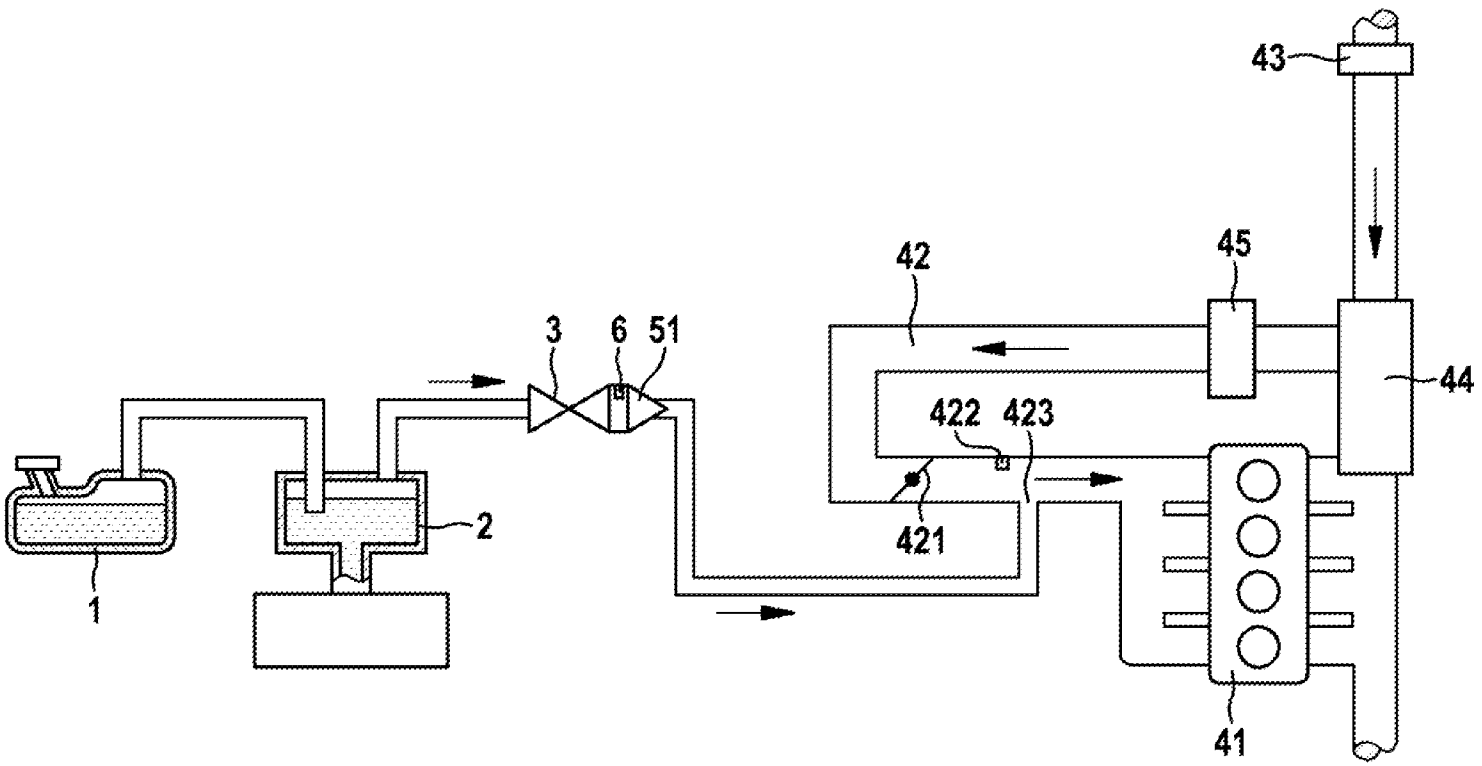
FIG. 2 shows one specific embodiment of a tank venting system according to the present invention, having a tank venting inlet point for engine operation with natural aspiration, the tank vent valve and the check valve having a one-piece design.

FIG. 2 shows a second specific embodiment of the present invention. In contrast to the first specific embodiment, tank vent valve 3, check valve 51, and pressure sensor 6 have a one-piece design in this present specific embodiment. The combined component has a cavity, between tank vent valve 3 and check valve 51, in which pressure sensor 6 is situated and in which negative pressure may be stored. This cavity has a volume in particular of at least 1 $cm^3$.

Figure 3:
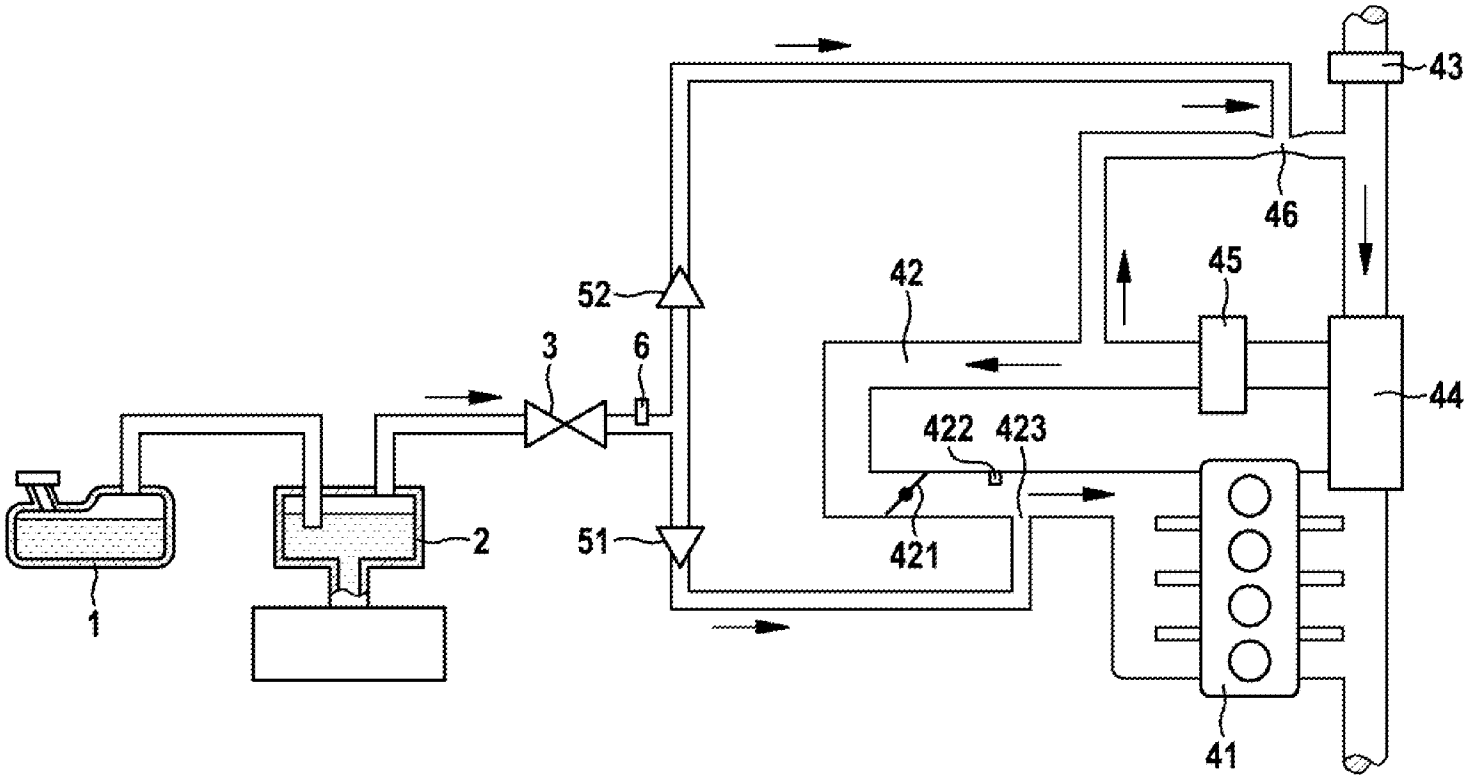
FIG. 3 shows one specific embodiment of a tank venting system according to the present invention, having two tank venting inlet points for engine operation with natural aspiration and full load tank venting.

FIG. 3 shows a third specific embodiment of the present invention. In this specific embodiment, a full load line branches off from the tank venting line between tank vent valve 3 and first check valve 51 (which corresponds to check valve 51 in the first specific embodiment), the full load line ending in a Venturi nozzle 46 as a full load inlet point. A second check valve 52 is situated in the full load line. This second check valve 52 prevents fluid transport in the full load line in the direction of tank vent valve 3. An additional line which likewise ends in Venturi nozzle 46 branches off from intake manifold 42. Venturi nozzle 46 is connected to the air inlet line between air filter 43 and turbocharger 44.

Figure 4:
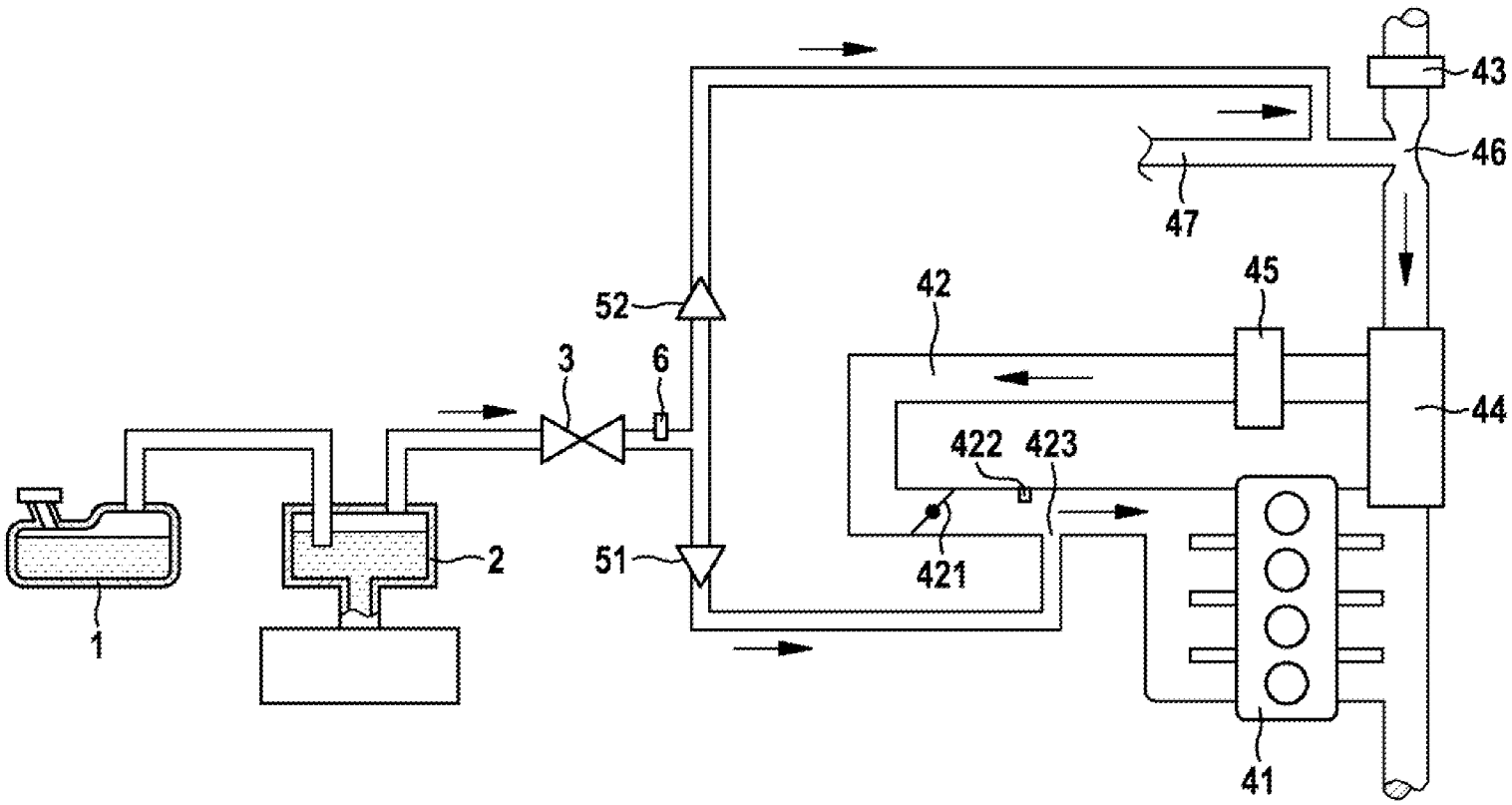
FIG. 4 shows another specific embodiment of a tank venting system according to the present invention, having two tank venting inlet points for engine operation with natural aspiration and full load tank venting.

FIG. 4 shows a fourth specific embodiment of the present invention. This specific embodiment differs from the third specific embodiment in that the Venturi nozzle is situated in the line between air filter 43 and turbocharger 44. There is no line which branches off from intake manifold 42 and ends in Venturi nozzle 46. A crankcase venting line 47 opens into the full load line. Crankcase venting line 47 is connected to internal combustion engine 41. This connection is not shown.

Figure 5:
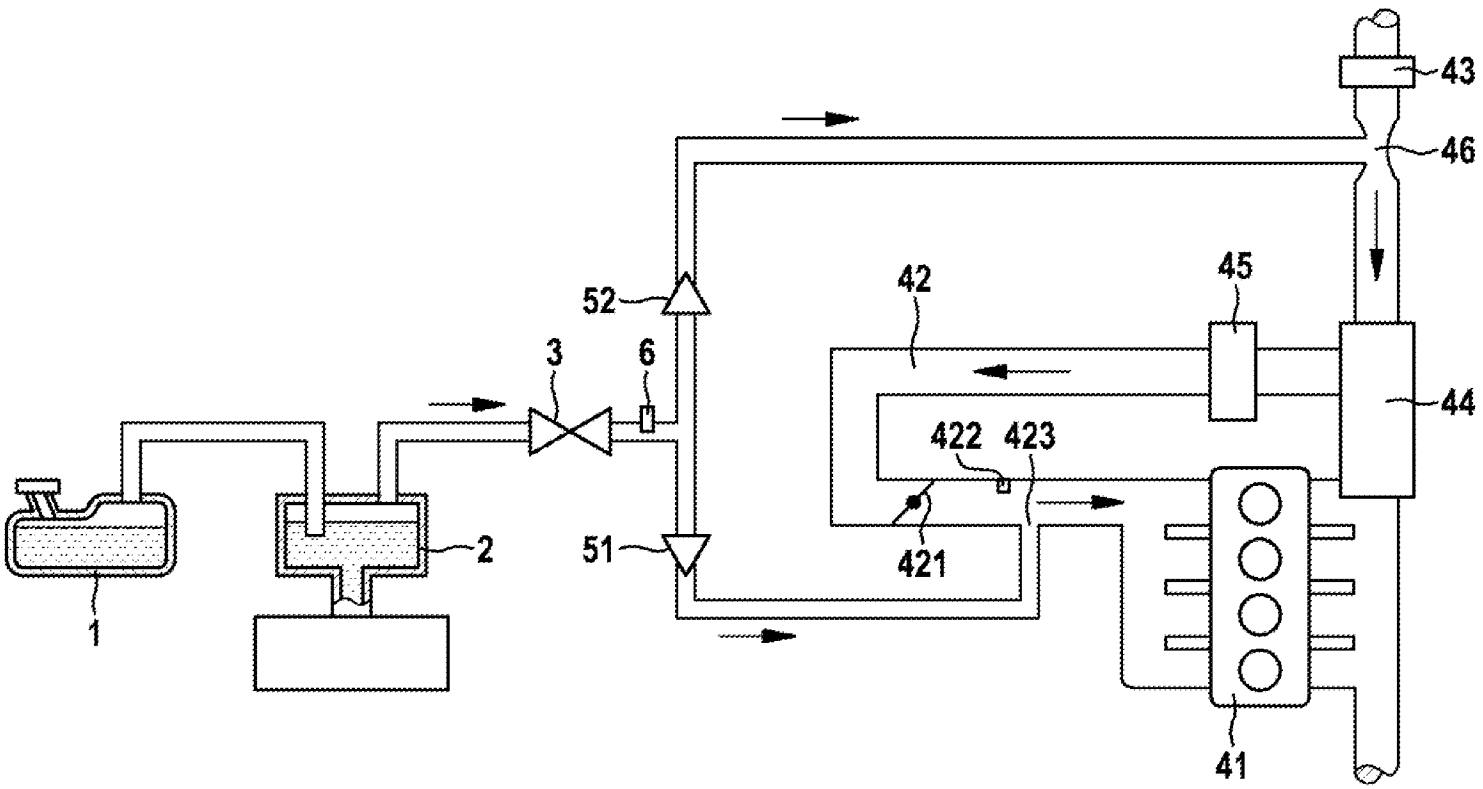
FIG. 5 shows yet another specific embodiment of a tank venting system according to the present invention, having two tank venting inlet points for engine operation with natural aspiration and full load tank venting.

FIG. 5 shows a fifth specific embodiment of the present invention. This specific embodiment differs from the fourth specific embodiment in that there is no crankcase venting line 47 that opens into the full load line.

In the tank venting systems according to the first through fifth specific embodiments of the present invention, various check paths are possible for diagnosing the tank venting systems.

When the internal combustion engine is switched off, electrically controllable tank vent valve 3 is usually not energized, and is in the closed state. If a pressure $p_1$ between tank vent valve 3 and check valve(s) 51, 52 essentially corresponds to ambient pressure $p_u$, i.e., the pressure in tank 1, a diagnosis may be begun when internal combustion engine 41 is started. Otherwise, according to the present invention, diagnoses are necessary prior to starting the internal combustion engine. In this case, tank vent valve 3 is briefly opened and reclosed before the engine is started, so that pressure $p_1$ becomes equal to ambient pressure $p_u$, i.e., the pressure in tank 1. If pressure $p_1$ is unchanged after controlling the tank vent valve, it is recognized that the tank vent valve is jammed shut. In both cases, before the engine is started, it is ascertained whether a plausible pressure $p_1$ is present, based on measured pressure $p_1$ and with the aid of the pressure difference of pressure $p_1$ and ambient pressure $p_u$ that is present over a pressure loss curve as a function of the switched-off period of the internal combustion engine and present when the engine is switched off, and by how much this pressure $p_1$ deviates from a computed setpoint value $p_{1s}$ of pressure $p_1$. If pressure $p_1$ is greater than $p_{1s}$ and or less than or equal to ambient pressure $p_u$, it is recognized that a leak is present at at least one of check valves 51, 52, at tank vent valve 3, or at the line between tank vent valve 3 and check valves 51, 52. To distinguish these defects, as an additional check the signal curve of pressure $p_1$ as well as the change in pressure $p_1$ are analyzed by opening and closing tank vent valve 3 when the internal combustion engine is running. If pressure $p_1$ is greater than $p_{1s}$ and greater than ambient pressure $p_u$, the sensor signal of pressure sensor $p_1$ is implausible, and it is recognized that an upward sensor drift is present. If pressure $p_1$ is less than $p_{1s}$, a downward pressure sensor drift $p_1$ is recognized. In this case, an additional check of the signal curve of pressure $p_1$ is made when the engine is started. When the internal combustion engine is started and tank vent valve 3 is not energized, if pressure sensor 6 indicates a pressure $p_1$ which is less than or equal to pressure $p_2$ in intake manifold 42 and which after a preset point in time drops to minimum pressure $p_2$ in intake manifold 42, it is recognized that pressure sensor 6 is not defective. In this case, tank vent valve 3 is opened and reclosed if pressure $p_2$ is less than ambient pressure $p_u$. However, if the tank venting system to be diagnosed has a second inlet point of a full load venting according to FIG. 3, tank vent valve 3 may then also be opened and closed if pressure $p_2$ is greater than ambient pressure $p_u$. If no pressure jumps in pressure $p_1$ can be determined, it is recognized that tank vent valve 3 is jammed in the closed state.

The curve of pressure $p_1$ is compared to the curve of pressure $p_2$ when internal combustion engine 41 is started. If $p_1$ is always less than or equal to $p_2$ and drops to the minimum value of $p_2$ after a preset time period, the tank venting line to first inlet point 423 into intake manifold 42 is present and intact, and check valves 51, 52 are operating properly, and tank vent valve 3 is closed. In this case, no further diagnosis is necessary during starting of the engine. However, if the curve of pressure $p_1$ is not equal to the curve of pressure $p_2$, and pressure $p_1$ corresponds to ambient pressure $p_u$, it is established that the tank venting line between pressure sensor 6 and inlet point 423 is interrupted. If the curve of pressure $p_1$ does not correspond to the curve of pressure $p_2$, and pressure $p_1$ is less than ambient pressure $p_u$ and greater than pressure $p_2$, the curve of pressure $p_1$ is analyzed during continued operation of internal combustion engine 41. If the curve of pressure $p_1$ essentially corresponds to pressure $p_2$ during continued operation of internal combustion engine 41 with natural aspiration, based on an assessment of the offset distance between $p_1$ and $p_2$ it is possible to deduce two error paths. For this purpose, a lower limiting pressure $p_{1u}$ is defined as pressure $p_1$ which is measured at the pressure sensor when the tank vent valve is open and the line between the tank vent valve and the check valve(s) is intact. An upper limiting pressure $p_{1o}$ is defined as the pressure which is measured at the pressure sensor when the valves are intact but the line between the tank vent valve and the check valve(s) has fallen off. If pressure $p_1$ corresponds to the curve of upper limiting pressure $p_{1o}$ or is between upper limiting pressure $p_{1o}$ and lower limiting pressure $p_{1u}$, the line between pressure sensor 6 and tank vent valve 3 is defective. If pressure $p_1$ is less than or equal to $p_{1u}$, tank vent valve 3 is jammed in the open state. If pressure $p_1$ is greater than lower limiting pressure $p_{1u}$ and less than ambient pressure $p_u$, and pressure jumps at $p_1$ are apparent due to energization of tank vent valve 3, check valve 52 is defective. Provided that an additional inlet point of the tank venting system according to FIGS. 3 through 5 is present at a Venturi nozzle 46 or negative pressure source, an appropriate diagnosis may likewise be carried out at an intake manifold pressure $p_2$ that is greater than ambient pressure $p_u$. If intake manifold pressure $p_2$ is greater than ambient pressure $p_u$, and pressure $p_1$ is greater than lower limiting pressure $p_{1u}$ and less than or equal to upper limiting pressure $p_{1o}$, the line between pressure sensor 6 and tank vent valve 3 is defective. If intake manifold pressure $p_2$ is greater than ambient pressure $p_u$, and pressure $p_1$ is less than or equal to lower limiting pressure $p_{1u}$ and greater than pressure $p_v$ at Venturi nozzle 46, tank vent valve 3 is jammed open. If pressure $p_1$ is greater than ambient pressure $p_u$, check valve 51 is defective. In the cases in which intake manifold pressure $p_2$ is not equal to ambient pressure $p_u$, it is deduced that the line between the pressure sensor and the intake manifold inlet point or Venturi inlet point has fallen off if pressure $p_1$ is equal to ambient pressure $p_u$.

During operation of internal combustion engine 41, with the aid of the method according to the present invention a check is made of tank vent valve 3, of the line between tank vent valve 3 and inlet point 423 of intake manifold 42, of the line between tank vent valve 3 and full load inlet point 46, and of check valves 51, 52. The check of tank vent valve 3 may be made during engine operation with natural aspiration ($p_2<p_u$) and also in the event of positive pressure in intake manifold 42 ($p_2>p_u$). The functioning of tank vent valve 3 may be checked by assessing the signal curve of pressure $p_1$ as a function of $p_2$, or by opening and reclosing the tank vent valve. If pressure jumps in pressure $p_1$ are detectable during opening and closing of the tank vent valve, it is established that tank vent valve 3 is not defective, and that the line between tank vent valve 3 and inlet point 423 of intake manifold 42 is likewise not defective. In contrast, if no pressure jumps are apparent, pressure $p_1$ is assessed based on pressures $p_{1u}$ and $p_{1o}$ as a function of intake manifold pressure $p_2$ (signal curve of pressure $p_1$ with respect to pressure $p_2$). It may thus be established either that the line between tank vent valve 3 and inlet point 423 of intake manifold 42 is operating properly and tank vent valve 3 is jammed in the open state, or that a diagnosis of tank vent valve 3 is not possible due to the fact that the line between tank vent valve 3 and pressure sensor 6 has fallen off. If no pressure jumps are apparent and the signal curve of pressure $p_1$ is below the signal curve of pressure $p_2$ or corresponds to same, it is established that tank vent valve 3 is jammed in the closed state, and the line between tank vent valve 3 and inlet point 423 in intake manifold 42 is operating properly. If pressure $p_1$ is below pressure $p_2$, it may also be established that check valve 51 in the specific embodiments according to FIG. 1 and FIG. 2, or the two check valves 51, 52 in the specific embodiment according to FIGS. 3 through 5, is/are not defective. In the event of positive pressure in intake manifold 42, a check is made as to whether pressure jumps in pressure $p_1$ are verifiable by opening and closing tank vent valve 3, or whether pressure $p_1$ is equal to pressure $p_v$ at Venturi nozzle 46 when tank vent valve 3 is not energized (closed), and pressure $p_1$ is equal to lower limiting pressure $p_{1u}$ when tank vent valve 3 is energized (open). If this is the case, tank vent valve 3 is not defective. In the specific embodiments according to FIGS. 3 through 5, the line between tank vent valve 3 and Venturi nozzle 46 also is not defective. In contrast, if no pressure jumps are apparent, or pressure $p_1$ deviates from $p_v$ at Venturi nozzle 46 or from lower limiting pressure $p_{1u}$, the signal curve of pressure $p_1$ is assessed. A correlation of pressure $p_1$ as a function of pressure $p_2$ is made. If pressure $p_1$ drops with increasing pressure $p_2$, it is established that the line between tank vent valve 3 and Venturi nozzle 46 is not defective. As a function of the change in pressure $p_1$ with respect to ambient pressure $p_u$, it may be deduced whether tank vent valve 3 is jammed in the open state or is jammed in the closed state. In both cases, a defect of tank vent valve 3 is deduced. If pressure $p_1$ is less than or equal to lower limiting pressure $p_{1u}$ and greater than pressure $p_v$ at Venturi nozzle 46, the tank vent valve is jammed open. If pressure $p_1$ is equal to pressure $p_v$ at Venturi nozzle 46, the tank vent valve is jammed shut. If no pressure jumps in pressure $p_1$ are recognizable, and pressure $p_1$ also corresponds to ambient pressure $p_u$ when tank vent valve 3 is open, it is recognized that the line between tank vent valve 3 and Venturi nozzle 46 is defective. If pressure $p_2$ is greater than ambient pressure $p_u$, and a positive pressure is measured at pressure sensor 6 which correlates with pressure $p_2$ when tank vent valve 3 is closed, and is less than pressure $p_2$ by an offset when tank vent valve 3 is open, i.e., pressure jumps are recognizable also during opening and closing of tank vent valve 3, it is established that check valve 51 is defective.

According to the present invention, the check of the line between tank vent valve 3 and inlet point 432 into intake manifold 42 is made when tank vent valve 3 is closed and also when tank vent valve 3 is open. If the pressure curve of pressure $p_1$ is below the pressure curve of pressure $p_2$ or corresponds to same when tank vent valve 3 is closed, if pressure $p_2$ is less than the ambient pressure, the line between tank vent valve 3 and inlet point 423 into intake manifold 42 is not defective. If pressure $p_1$ adapts to a pressure that corresponds to minimum achieved pressure $p_2$, check valves 51, 52 likewise are not defective. However, if pressure $p_1$ corresponds to ambient pressure $p_u$, it is established that the line between tank vent valve 3 and inlet point 423 into intake manifold 42 has fallen off. If the pressure curve of measured pressure $p_1$ is continuously less than pressure $p_2$ by an offset and follows the change in pressure $p_2$, i.e., after a preset time period, pressure sensor 6 detects a pressure $p_1$ that is less than minimum achievable pressure $p_2$, a defect in first pressure sensor 6 is recognized, namely, a downward sensor drift. If the curve of pressure $p_1$ corresponds to that of pressure $p_2$ when pressure $p_2$ increases, it is established that check valve 51 is jammed in the open state.

Pressures $p_2$ and $p_1$ are assessed when tank vent valve 3 is open. If pressure $p_1$ is greater than pressure $p_2$, and the difference between $p_1$ and $p_2$ decreases with increasing intake manifold pressure $p_2$, it is established that the line between tank vent valve 3 and inlet point 423 into intake manifold 42 is not defective. This check is made when intake manifold pressure $p_2$ is less than ambient pressure $p_u$. If the pressure difference between $p_1$ and $p_2$ does not decrease with increasing pressure $p_2$, it is established that an upward sensor drift of pressure sensor 6 is present. If pressure $p_1$ is less than or equal to upper limiting pressure $p_{1o}$ and greater than lower limiting pressure $p_{1u}$, the line between tank vent valve 3 and pressure sensor 6 is defective. If pressure $p_1$ is less than or equal to lower limiting pressure $p_{1u}$ and greater than negative pressure $p_v$ at Venturi nozzle 46, tank vent valve 3 is open. This is based on the fact that tank vent valve 3 has a throttle effect even in the open state, and if the line to tank vent valve 3 downstream from pressure sensor 6 has fallen off, a much higher pressure curve is therefore still measurable than when tank vent valve 3 is open and the line is intact.

In the tank venting system according to FIG. 3, a check is also made of the line between tank vent valve 3 and full load inlet point 46 when internal combustion engine 41 is running. This check is possible only when pressure $p_2$ is greater than ambient pressure $p_u$. Tank vent valve 3 may be opened for the check and reclosed, or the signal curve of pressure sensor 6 is assessed when the tank vent valve is open or closed. If a pressure jump in pressure $p_1$ is measured, it is established that tank vent valve 3 is operating properly, and also that the line from tank vent valve 3 to full load venting 46 is operating properly. A line check is made as a function of the measurable pressure curve. In the event that pressure $p_1$ is less than ambient pressure $p_u$ and also less than the maximum pressure that is generatable by Venturi nozzle 46, during the transition from naturally aspirated operation, in which pressure $p_2$ is less than ambient pressure $p_u$, into supercharged operation, in which pressure $p_2$ is greater than ambient pressure $p_u$, negative pressure $p_1$ must be reduced when pressure $p_2$ essentially corresponds to ambient pressure $p_u$. For this purpose, tank vent valve 3 must be briefly opened. Pressure $p_1$ then essentially corresponds to ambient pressure $p_u$. If tank vent valve 3 is now closed, a pressure $p_1$ results, as a function of pressure $p_2$, which is less than ambient pressure $p_u$. This indicates that the line between tank vent valve 3 and Venturi nozzle 46 is not defective, and also that check valve 51 is not defective. Check valve 52 is likewise not defective, provided that pressure $p_1$ remains constant when pressure $p_2$ drops to ambient pressure $p_u$. When tank vent valve 3 is open, pressure $p_1$ is equal to ambient pressure $p_u$ during the transition from naturally aspirated operation into charge pressure operation. If pressure $p_2$ increases above ambient pressure $p_u$, pressure $p_1$ once again drops. Pressure $p_1$ is a function of intake manifold pressure $p_2$ and negative pressure $p_v$ of Venturi nozzle 46 which is generated by intake manifold pressure $p_2$, and is therefore computed as lower limiting pressure $p_{1u}$ as a function of intake manifold pressure $p_2$, using characteristic curves. Pressure $p_1$ which is measured at pressure sensor 6 when the tank vent valve is open and the line between tank vent valve 3 and check valve 51 or check valves 51, 52 is intact is defined as lower limiting pressure $p_{1u}$. If pressure $p_1$ is less than or equal to lower limiting pressure $p_{1u}$ and greater than pressure $p_v$ at Venturi nozzle 46, it is established that the line between tank vent valve 3 and Venturi nozzle 46 is not defective. For a starting state in which pressure $p_2$ is greater than ambient pressure $p_u$, tank vent valve 3 is opened briefly one time. Pressure $p_1$ then increases, either from the value that is stored as intake manifold pressure $p_2$ (less than ambient pressure $p_u$) or from pressure $p_v$ at Venturi nozzle 46, to lower limiting pressure $p_{1u}$ until tank vent valve 3 is reclosed. If pressure $p_1$ does not subsequently drop back to the value of pressure $p_v$ at Venturi nozzle 46, it is established that the line between tank vent valve 3 and Venturi nozzle 46 is defective.

Lastly, according to the present invention the functioning of check valves 51, 52 may also be checked. For this purpose, tank vent valve 3 is closed, and lowest intake manifold pressure $p_2$ remains enclosed as pressure $p_1$ in the line between tank vent valve 3 and check valve 51 or check valves 51, 52. For loads in which $p_2>p_u$, in the specific embodiment according to FIG. 3, lowest pressure $p_v$ that is generatable by Venturi nozzle 46 remains stored. A check as to whether pressure $p_1$ may be maintained for a preset time period when pressure $p_2$ once again increases above pressure $p_1$ may be made immediately following the start of internal combustion engine 41. Shortly before internal combustion engine 41 is switched off, for example when a switchover is made to electric driving mode in a hybrid vehicle, tank vent valve 3 is quickly closed, so that for a pressure $p_2$ which is less than ambient pressure $p_u$, pressure $p_2$ may be stored as pressure $p_1$. Tank vent valve 3 is kept closed for the stop phase of internal combustion engine 41, for example during control unit overrun, and a measurement is made of how quickly pressure $p_1$ increases to ambient pressure $p_u$. If pressure $p_1$ is maintained for a preset time period, it may be established that check valves 51, 52 are not defective. If tank vent valve 3 is briefly reopened during the stop phase or during control unit overrun, based on the change in pressure $p_1$ to ambient pressure $p_u$ it may be deduced that tank vent valve 3 is functioning. When internal combustion engine 41 is started, the starting diagnosis described above may subsequently be begun. In contrast, if negative pressure $p_1$ is not maintained, and the check of tank vent valve 3 and the check of the lines has already been completed, it having been established that tank vent valve 3 and the lines are not defective, the curve of pressure $p_1$ with respect to pressure $p_2$ is subsequently analyzed with the tank vent valve closed. If pressure $p_1$ always corresponds to pressure $p_2$ in operating range $p_2<p_u$, check valve 51 is defective. If pressure $p_1$ is also greater than $p_u$ when $p_2>p_u$, it may also be deduced that check valve 51 is defective. In contrast, if pressure $p_1$ is always greater than $p_2$ in range $p_2<p_u$, and adapts to a value greater than $p_{1u}$ when $p_2>p_u$ and tank vent valve 3 is open, and when tank vent valve is closed, adapts to pressure $p_v$ at Venturi nozzle 46 and this negative pressure is maintained even when tank vent valve 3 is closed, if pressure $p_2$ once again drops but does not go below ambient pressure $p_u$, check valve 51 is operating properly and check valve 52 is defective.

All method steps according to the present invention may be executed by a computer program which runs on a computer or control unit that is connected to the tank venting system. A computer program product having program code, stored on a machine-readable medium, is used for carrying out the method according to the present invention when the program is executed on a computer or control unit. It is thus easily possible to implement the method according to the present invention in a control unit.

What is claimed is:

1. A method for diagnosing a tank vent valve in a tank venting system for an internal combustion engine having an intake manifold, a fuel tank, and an activated carbon filter, the tank venting system including a tank valve situated in a line connecting the activated carbon filter to the intake manifold, at least one check valve situated in the line between the tank vent valve and the intake manifold, and a pressure sensor situated in the line between the tank vent valve and the check valve, the method comprising:

while the internal combustion engine is switched off, opening the tank vent valve measuring, via the pressure sensor, a first pressure between the tank vent valve and the check valve;

subsequently closing the tank valve vent when the first pressure is not equal to ambient pressure; and (i) after the tank vent valve is closed, measuring, via the pressure sensor, the first pressure between the tank vent valve and the check valve, and determining an upward sensor drift if the first pressure is greater than the sum of the ambient pressure and a predefined error threshold;

(ii) after the tank vent valve is closed and the first pressure is measured, if the first pressure is less than a setpoint pressure which is ascertained over the engine switched-off period on the basis of the difference between the first pressure at the immediately preceding time the internal combustion engine was switched off and the ambient pressure, measuring a curve of the first pressure when the internal combustion engine is started, and detecting a downward sensor drift if at least one of (a) at any point in time during the starting operation, the first pressure is less than a second pressure in the intake manifold of the internal combustion engine by a predefined error threshold, and (b) at the end of the starting operation, the first pressure is less than a minimum achieved pressure; and (iii) at the end of a starting operation, opening the tank vent valve if the second pressure is less than the ambient pressure and determining a jamming of the tank vent valve if one of no change in the first pressure is measured, or the first pressure remains equal to the minimum achieved pressure since the starting of the engine.

2. The method as recited in claim 1, wherein when the first pressure is not equal to the second pressure in the intake manifold of the internal combustion engine during starting, the following conditions are determined:

a) if the first pressure is equal to the ambient pressure, the line between the pressure sensor and an inlet point of the tank venting line into the intake manifold is determined as being interrupted, and b) if the first pressure is less than the ambient pressure and greater than the second pressure in the intake manifold, and the first pressure during continued operation of the internal combustion engine is equal to the second pressure plus the predefined error threshold, a lower limiting pressure is defined as the first pressure which is measured at the pressure sensor when the tank vent valve is open and the line between the tank vent valve and the check valve is intact, and an upper limiting pressure is defined as the first pressure which is measured at the pressure sensor when the tank vent valve and the check valve are intact but the line between the tank vent valve and the check valve has fallen off, and b1) if the first pressure is no greater than the upper limiting pressure and greater than the lower limiting pressure, the pressure line between the pressure sensor and the tank vent valve is recognized as being defective;

b2) if the first pressure is no greater than the lower limiting pressure and greater than the second pressure in the intake manifold, the tank vent valve is recognized as being open;

b3) if the first pressure is greater than the second pressure in the intake manifold and less than the ambient pressure, in an engine system which has two tank venting inlet points and which includes a full load inlet point, (i) the check valve of the line between the tank vent valve and the full load inlet point is recognized as being defective if a change in pressure occurs when the tank vent valve is energized, and (ii) the pressure line between the pressure sensor and the tank vent valve is recognized as being defective when no pressure jump occurs when the tank vent valve is energized.

3. A method for diagnosing a tank vent valve in a tank venting system for an internal combustion engine having an intake manifold, a fuel tank, and an activated carbon filter, the tank venting system including a tank valve situated in a line connecting the activated carbon filter to the intake manifold, at least one check valve situated in the line between the tank vent valve and the intake manifold, and a pressure sensor situated in the line between the tank vent valve and the check valve, the method comprising:

measuring, via the pressure sensor, a first pressure between the tank vent valve and the check valve during operation of the internal combustion engine;

opening and closing the tank vent valve during the operation of the internal combustion engine, wherein during the operation of the internal combustion engine, if the first pressure does not vary when the tank vent valve is opened and closed, a lower limiting pressure is defined as the first pressure which is measured at the pressure sensor when the tank vent valve is open and the line between the tank vent valve and the check valve is intact, and an upper limiting pressure is defined as the first pressure which is measured at the pressure sensor when the tank vent valve and the check valve are intact but the line between the tank vent valve and the check valve has fallen off, and if a second pressure in the intake manifold is less than the ambient pressure, and (i) if the tank vent valve has been recognized as defective, the tank vent valve is recognized as being jammed open if the first pressure is no greater than the lower limiting pressure and greater than the second pressure in the intake manifold, (ii) if a diagnosis of the tank vent valve is not possible, a line defect is recognized if the first pressure is greater than the lower limiting pressure and less than the ambient pressure, (iii) if the first pressure is no greater than the second pressure in the intake manifold and remains at the minimum achieved value, the tank vent valve is recognized as being jammed shut, or (iv) if the first pressure is consistently equal to the second pressure in the intake manifold, the check valve is recognized as being defective, if the second pressure in the intake manifold is greater than the ambient pressure, and (v) if the first pressure drops with increasing of the second pressure in an engine system which has two tank venting inlet points and which includes a full load inlet point, the tank vent valve is recognized as being jammed open if the first pressure is not greater than the lower limiting pressure and greater than the pressure at the full load inlet point, and the tank vent valve is recognized as being jammed shut if the first pressure is equal to the pressure at the full load inlet point, (vi) if the first pressure is equal to the ambient pressure when the tank vent valve is open, the line between the pressure sensor and the full load inlet point is recognized as being defective, (vii) if the first pressure is greater than the ambient pressure, and the first pressure is correlated with the second pressure, the check valve is recognized as being defective, and (viii) if the first pressure is greater than the lower limiting pressure and no greater than the upper limiting pressure, the line between the tank vent valve and the pressure sensor is recognized as being defective.

4. The method as recited in claim 3, wherein during operation of the internal combustion engine, when the tank vent valve is closed, the first pressure is no greater than the second pressure in the intake manifold, and the second pressure is less than the ambient pressure, (i) a falling off of the line is recognized if the first pressure is equal to the ambient pressure, (ii) a downward sensor drift is recognized if the first pressure is continuously less than the second pressure by an offset, and (iii) the check valve is recognized as being jammed open if the first pressure is equal to the second pressure with increasing of the second pressure, when the tank vent valve is open, a lower limiting pressure is defined as the first pressure which is measured at the pressure sensor when the tank vent valve and the line between the tank vent valve and the check valve is intact, and an upper limiting pressure is defined as the first pressure which is measured at the pressure sensor when the tank vent valve and the check valve are intact but the line between the tank vent valve and the check valve has fallen off, and (i) the line between the tank vent valve and the pressure sensor is recognized as having fallen off if the first pressure is greater than the lower limiting pressure and no greater than the upper limiting pressure, and (ii) the line between the pressure sensor and a tank venting inlet point is recognized as having fallen off if the first pressure is equal to the ambient pressure.

5. The method as recited in claim 3, wherein during operation of the internal combustion engine, during the transition of the second pressure in the intake manifold from a value less than the ambient pressure to a value greater than the ambient pressure, the tank vent valve is opened until the first pressure corresponds to the ambient pressure, and a defect in the line between the tank vent valve and a full load inlet point is recognized if the first pressure does not fall below the ambient pressure after the tank vent valve is closed.

6. The method as recited in claim 3, wherein prior to switching off the internal combustion engine, the tank vent valve is closed in order to store the second pressure in the intake manifold as the first pressure between the tank vent valve and the check valve, and after closing of the tank vent valve, an increase in the first pressure is measured and the tank vent valve and the lines have been assessed as defect-free, (i) the check valve of an inlet point into the intake manifold is recognized as being defective if the first pressure is consistently equal to the first pressure and the second pressure is less than the ambient pressure, (ii) the check valve of the full load inlet point is recognized as being defective if the first pressure is always greater than the second pressure by an offset and the second pressure is less than the ambient pressure, and when the second pressure is greater than the ambient pressure, the first pressure remains constant when the second pressure drops.

* * * * *